United States Patent [19]

Sado et al.

[11] 4,357,266

[45] Nov. 2, 1982

[54] FLEXIBLE RESISTOR COMPOSITIONS

[75] Inventors: Ryoichi Sado, Saitama; Kenichi Okada, Ageo, both of Japan

[73] Assignee: Shin-Etsu Polymer Co., Ltd., Tokyo, Japan

[21] Appl. No.: 227,619

[22] Filed: Jan. 23, 1981

[30] Foreign Application Priority Data

Jan. 25, 1980 [JP] Japan ..... 55-7634

[51] Int. Cl.[3] ..... H01B 1/02

[52] U.S. Cl. ..... 252/512; 252/511; 252/518; 338/114; 524/442

[58] Field of Search ..... 252/511, 512, 518; 260/37 SB, 37 R, 37 M; 338/20, 21, 114

[56] References Cited

U.S. PATENT DOCUMENTS 3,697,450 10/1972 Takenaka et al. ..... 252/511

4,020,014 9/1977 Service et al. ..... 252/511

4,062,813 12/1977 Andrianor et al. ..... 252/511

4,130,707 12/1978 Leiser et al. ..... 252/511

*Primary Examiner*—Joseph L. Schofer

*Assistant Examiner*—J. L. Barr

*Attorney, Agent, or Firm*—Hopgood, Calimafde, Kalil, Blaustein & Judlowe

[57] ABSTRACT

The invention provides a novel composition capable of giving an electrically conductive, flexible shaped body having stability in the applied voltage vs. current performance. The composition comprises an electrically insulating polymeric material having flexibility such as a diorganopolysiloxane, a finely divided particulate or fibrous metallic silicon such as a finely powdered semiconductor grade high purity metallic silicon dispersed in the insulating polymeric material as the matrix and an organosilicon compound having at least one functional group directly bonded to the silicon atom or at least one peroxy linkage directly bonded to the silicon atom in a molecule.

5 Claims, 3 Drawing Figures

FLEXIBLE RESISTOR COMPOSITIONS

BACKGROUND OF THE INVENTION

The present invention relates to a flexible composition suitable as a material for electric resistor elements or varistor elements. More particularly, the present invention relates to a composition composed of a polymeric material as the matrix and a finely dispersed phase of a metalic silicon dispersed in the matrix in such an amount that the shaped body of the composition may have a desired electroconductivity exhibiting very stable characteristic relationships between the applied voltage and the current passing therethrough regardless of the highly flexible condition of the shaped body.

There are hitherto known various kinds of flexible resistor materials shaped with a composition prepared by dispersing an electroconductive or semiconductive finely divided material in a matrix having flexibility such as rubbers and certain kinds of plastics. These materials are used as a resistor element or as a varistor element and widely used in a variety of applications where flexibility of the material is essential as being subjected to bending or under vibration.

One of the serious problems in these flexible materials is that the resistance performance of the material, i.e. the relationship between the voltage applied to the shaped body thereof and the electric current passing therethrough, is not always sufficiently stable, especially, when the shaped body is subjected to bending or used under vibration.

The reason for the above mentioned undesirable phenomenon is presumably that the insulating polymeric material as the matrix and the electroconductive or semiconductive phase finely dispersed therein, which may be a metal or a semiconductor, have relatively poor affinity in the interface therebetween owing to their so much diversified surface properties causing unstable interfacial condition when the shaped body of the composition is subjected to bending or under vibration. This problem is more serious when the dispersed phase is made of a semiconductor which requires to be incorporated in the matrix in a relatively large amount by volume in order to impart a sufficiently high electric conductivity to the shaped body to be used as a resistor element or as a varistor element.

Various attempts have been made to solve the above described problem but with no satisfactory results.

SUMMARY OF THE INVENTION

It is therefore an object of the present invention to provide a novel and improved flexible composition to be shaped, for example, into a resistor element capable of excellently stable voltage-resistance characteristics even when the resistor is subjected to bending or under vigorous vibration.

The inventive composition comprises, as uniformly blended together, (a) an electrically insulating polymeric material having flexibility, (b) a finely divided particulate or fibrous material of a metallic silicon dispersed in the polymeric material, and (c) an organosilicon compound having at least one functional group bonded to the silicon atom in a molecule or having at least one peroxy linkage —O—O— directly bonded to the silicon atom in a molecule.

Highest performance of the inventive composition is obtained with a combination of the above mentioned components (a) and (b), of which the component (a) is an organopolysiloxane such as an organopolysiloxane gum for formulating a silicone rubber with admixture of a reinforcing filler and other conventional additive ingredients and the component (b) is a finely pulverized metallic silicon.

DETAILED DESCRIPTION OF THE PREFERRED EMBODIMENTS

Figure 1:
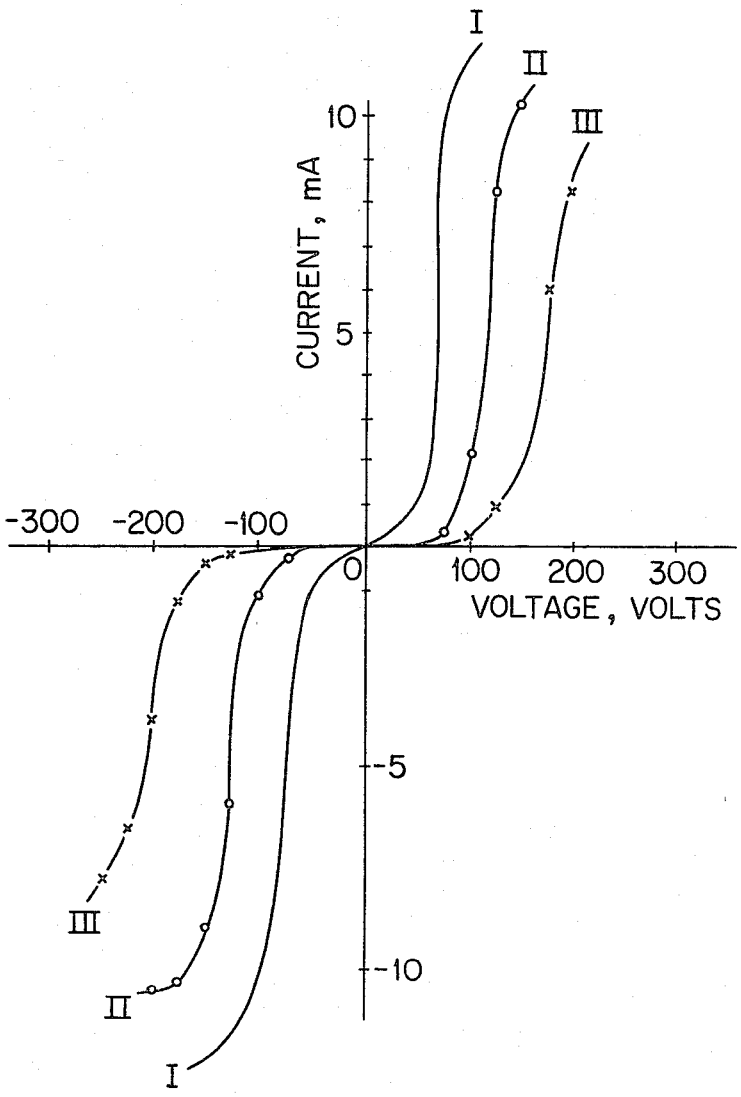
FIG. 1 to FIG. 3 are each a graphic showing of the relationship of the voltage applied to and the electric current passing through a shaped body prepared with the inventive resistor composition.

As is mentioned above, the essential components in the inventive flexible composition are the insulating polymeric material as the matrix phase, the finely dispersed phase of a metallic silicon and the organosilicon compound.

The material for the matrix phase may be selected from a diversity of polymeric materials having flexibility such as rubbery polymers including natural rubber and various kinds of organic synthetic rubbers or silicone rubbers as well as certain kinds of thermoplastic resins and thermosetting resins provided that the resins can retain sufficient flexibility after curing. Particularly suitable is an organopolysiloxane-based one such as a silicone rubber. These polymeric materials may contain various kinds of conventional additive ingredients such as reinforcing fillers, extending fillers, stabilizers, heat resistance improvers, rust inhibitors, curing or cross-linking agents, lubricants, plasticizers, coloring agents and the like according to need and the type of the polymeric material. Care must be taken in this case that the additive ingredient does not unduly denaturate the surface properties of the metallic silicon dispersed in the polymeric material or the electrodes to be bonded to the surface of the shaped body of the inventive composition.

The second component is the finely divided particulate or fibrous material of a metallic silicon which is essential to impart electroconductivity to the shaped body of the inventive composition. The grade or purity of the metallic silicon is not particularly limitative ranging from a metallurgical grade to a high-purity semiconductor grade according to need. In any way, the metallic silicon used in the present invention preferably has a purity of silicon of at least 90% by weight.

The metallic silicon is used typically in the form of a finely divided powder but it may be in a fibrous form such as a so-called whisker material. When the metallic silicon is particulate, it has desirably a particle size distribution to pass a Tyler standard screen of 100 mesh openings or, preferably, 200 mesh openings. When the metallic silicon is fibrous, the diameter of the fiber is 200 μm or smaller or, preferably, 20 μm or smaller and the length of each of the chopped filaments is 10 mm or smaller or, preferably, 5 mm or smaller so as that satisfactorily good dispersibility in the matrix is obtained.

The amount of the metallic silicon to be blended with the polymeric material is naturally determined in accordance with the particularly desired resistance performance of the shaped body of the inventive composition as well as the grade of the metallic silicon. It is usually in the range from 5 to 75% by volume based on the total volume of the composition. When the metallic silicon is particulate, in particular, a relatively large amount by volume of the material of, for example, 20 to 75% by volume can be incorporated in the polymer matrix in comparison with a fibrous material.

The third essential component in the inventive composition is an organosilicon compound having a specific chemical structure. This is, the organosilicon compound is an organosilane or an organopolysiloxane having at least one functional group bonded to the silicon atom in a molecule or an organisilicon compound having at least one peroxy linkage in a molecule. The functional groups are exemplified by alkoxy groups, 3-glycidyloxypropyl group, 3-methacryloxypropyl group, N-(2-aminoethyl)-3-aminopropyl group, 3-chloropropyl group, 2-(3,4-epoxycyclohexyl) ethyl group, 3-mercaptopropyl group and the like.

Particular examples of the functional group-containing organosilicon compounds are vinyltrimethoxysilane, vinyltriethoxysilane, vinyl tris(2-methoxyethoxy)-silane, 3-glycidyloxypropyl trimethoxysilane, 3-methacryloxypropyl trimethoxysilane, N-(2-aminoethyl)-3-aminopropyl methyldimethoxysilane, N-(2-aminoethyl)-3-aminopropyl trimethoxysilane, 3-chloropropyl trimethoxysilane, 2-(3,4-epoxycyclohexyl)ethyl trimethoxysilane, 3-mercaptopropyl trimethoxysilane and the like known as a silicone coupling agent.

Several examples of the organosilicon compounds containing at least one peroxy linkage in a molecule are tert-butylperoxy trimethylsilane, tert-butylperoxy triphenylsilane, (1,1-dimethylpropyl)peroxy trimethylsilane, 2-phenyl-2-propylperoxy trimethylsilane, 1-tetralylperoxy trimethylsilane, di(tert-butylperoxy) diethylsilane, di(tert-butylperoxy) diphenylsilane, tri(tert-butylperoxy) vinylsilane, tri(tert-butylperoxy) methylsilane, tri(tert-butylperoxy) allylsilane, tetra(tert-butylperoxy) silane, tri(tert-butylperoxy)silane, hexamethyldisilperoxane, trimethylsilyl hydroperoxide and the like.

The above named organosilane compounds may be used either as such or as a partial hydrolysis-condensation product thereof.

The amount of the above described organosilicon compound in the inventive composition naturally should be determined in accordance with the kind of the polymeric material as well as the proportion of these materials and the particle size distribution of the metallic silicon. It is usually in the range from 0.1 to 10 parts by weight or, preferably, from 0.5 to 5 parts by weight per 100 parts by weight of the polymeric matrix material.

The incorporation of the organosilicon compound in the inventive composition is very effective not only to improve the affinity between the particles of the metallic silicon and the polymeric material as the matrix but also to greatly improve the adhesive bonding of the resistance element shaped with the inventive composition and the electrode to be bonded thereto. Thus, the inventive composition before curing prepared by uniformly blending the polymeric material, metallic silicon powder and the organosilicon compound together with a curing agent is contacted with a metal electrode and heated under pressure so that the inventive composition is cured and firmly bonded to the surface of the electrode without the use of any primer or adhesive agent. In this case, the material of the electrode is not particularly limitative and may be any kind of metals as well as semiconductive oxide materials such as AgO, $In_2O_3$, $SnO_2$ and the like. It is of course that the configuration of the electrode is determined according to the particular need without limitation. The inventive composition may be used as diluted to a solution or paste by use of an organic solvent according to need.

Following are examples to illustrate the inventive composition in further detail, in which the inventive compositions were shaped into a resistor element containing a metallic silicon powder as the electroconductive dispersed phase.

EXAMPLE 1

A curable rubber composition was prepared by uniformly blending, in a mixing roller, 100 parts by volume of a methylvinylpolysiloxane having a viscosity of 3,000,000 centistokes at 25° C. as composed of 0.2% by moles of methylvinylsiloxane units and 99.8% by moles of dimethylsiloxane units terminated at both chain ends with trimethylsilyl groups, 188 parts by volume of a powdery metallic silicon of about 98% purity having such a particle size distribution that at least 90% by weight of the powder passes a screen of 200 mesh by the Tyler standard and 1.5% by weight of tris(tert-butylperoxy) vinylsilane based on the polysiloxane. The thus prepared curable rubber composition was shaped into a sheet of 0.3 mm thickness by use of a calendering roller. A disc of 10 mm diameter was taken from the above sheet by punching and the disc was sandwiched coaxially by two copper electrodes of 35 μm thickness, one having a diameter of 10 mm and the other having a diameter of 3.3 mm. The sheet and the electrodes were placed between two hot plates with two sheets of polytetrafluoroethylene resin as release sheets therebetween and pressed at 170° C. for 10 minutes under a pressure of 10 kg/cm$^2$ followed by post-curing in an air oven at 200° C. for 1 hour. Curing of the rubber composition was complete and good adhesive bonding was obtained between the cured rubber sheet and the electrodes.

Lead wires were bonded to each of the copper electrode by soldering and the relationship between the D.C. voltage applied to the electrodes and the electric current passing through the rubber sheet was determined to give the results as shown by the curve I in FIG. 1. The reproducibility of the voltage-current relationship was satisfactory even when the test specimen was folded into two.

The same experimental procedure as above was repeated except that the thickness of the disc shaped with the inventive composition was increased to 0.5 mm or 0.7 mm instead of 0.3 mm. The results of the measurements of the voltage-current relationship are shown by the curves II and III in FIG. 1, respectively.

EXAMPLE 2

Figure 2:
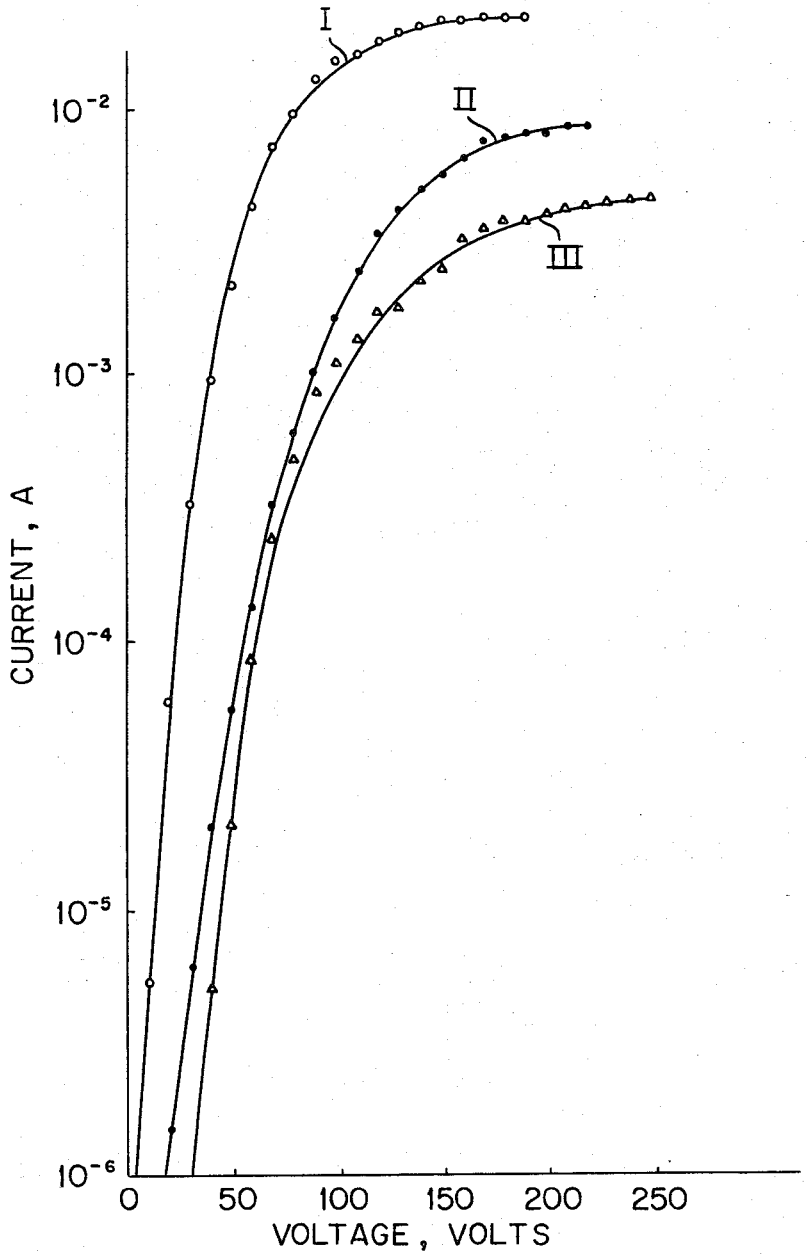

Three resistor discs of each 0.3 mm thickness were prepared with compositions similar to that used in Example 1 except that the amount of the metallic silicon powder was decreased to 43 parts, 32 parts or 22 parts, each of the parts being by parts by volume, instead of 188 parts by volume. The results of the measurements of the voltage-current relationship undertaken with these disc specimens are shown by the curves I, II and III in FIG. 2, respectively.

EXAMPLE 3

Figure 3:
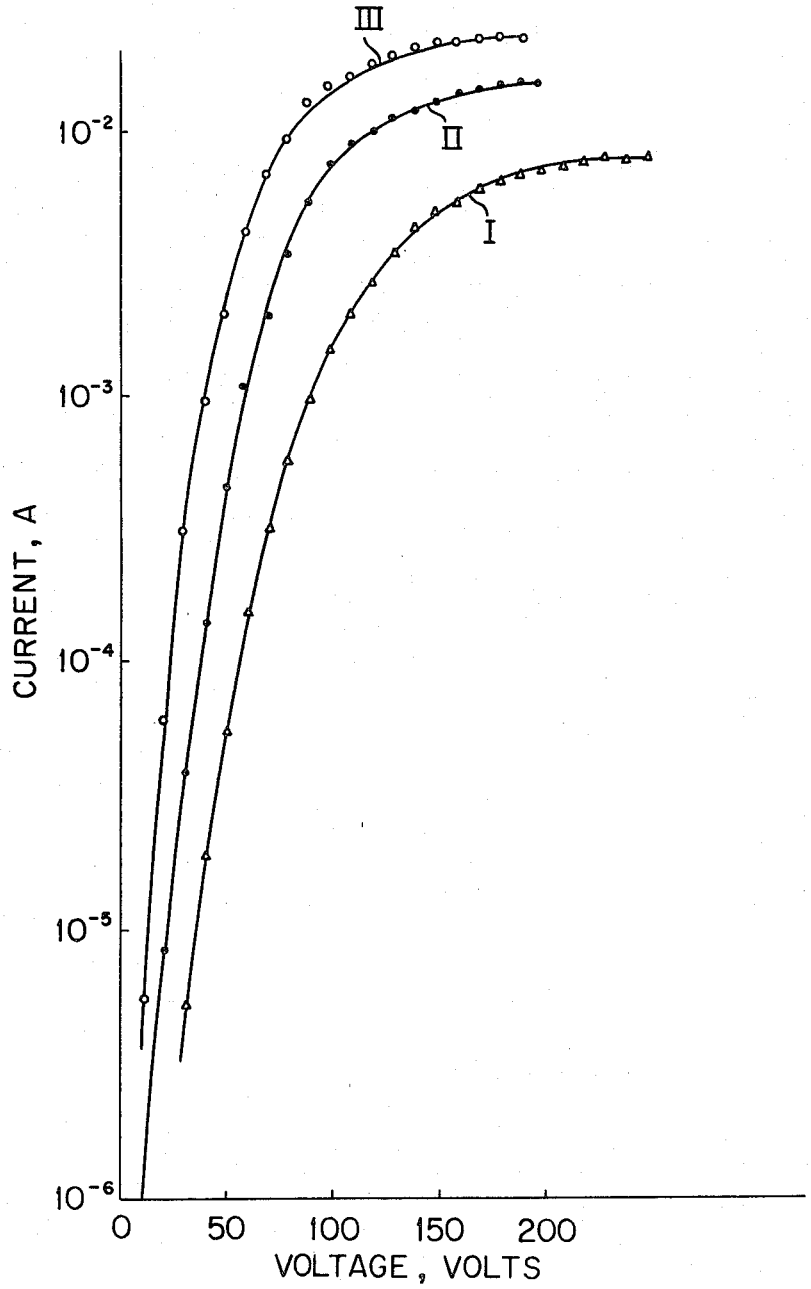

Disc specimens each having a diameter of 30 mm and 0.3 mm thickness were prepared with the same composition as used in Example 1. Each of the specimens was provided with two copper electrodes coaxially on the opposite surfaces, one having a diameter of 20 mm and the other having a diameter of 10 mm, 19 mm or 25 mm. The results of the measurements of the voltage-current relationship are shown by the curves I, II and III, respectively, in FIG. 3.

What is claimed is:

1. An electrically conductive flexible composition which comprises (a) an electrically insulating polymeric material having flexibility, (b) from 5 to 75% by volume based on the total volume of the composition of a metallic silicon dispersed in the electrically insulating polymeric material, wherein said silicon is in either finely divided particulate form with the particle size being such as to pass a screen of 100 mesh openings or in fibrous form such that the fiber diameter does not exceed 200 μm, and (c) an organosilicon compound having at least one functional group bonded to the silicon atom in a molecule or having at least one peroxy linkage directly bonded to the silicon atom in a molecule.

2. The composition as claimed in claim 1 wherein the organosilicon compound is tri(tert-butylperoxy) vinylsilane.

3. The composition as claimed in claim 1 wherein the polymeric material is a diorganopolysiloxane.

4. The composition as claimed in claim 1 wherein the metallic silicon is in a particulate form.

5. The composition as claimed in claim 1 wherein the amount of the organosilicon compound as the component (c) is in the range from 0.1 to 10% by weight based on the amount of the electrically insulating polymeric material.

* * * * *